US008231949B2

(12) United States Patent
Frank

(10) Patent No.: US 8,231,949 B2
(45) Date of Patent: Jul. 31, 2012

(54) AROMABAG AND AROMAFOIL MADE OF ALUMINUM

(75) Inventor: Thomas Frank, Nieder-Olm (DE)

(73) Assignee: Frato GmbH, Nieder-Olm (DE)

( * ) Notice: Subject to any disclaimer, the term of this patent is extended or adjusted under 35 U.S.C. 154(b) by 920 days.

(21) Appl. No.: 10/907,579

(22) Filed: Apr. 6, 2005

(65) Prior Publication Data

US 2006/0153952 A1 Jul. 13, 2006

(30) Foreign Application Priority Data

Jan. 12, 2005 (DE) ..... 20 2005 000 387 U

(51) Int. Cl.
*B32B 1/02* (2006.01)
*B32B 1/0818* (2006.01)

(52) U.S. Cl. ..... 428/35.2; 428/34.1; 428/34.2; 428/35.7; 428/35.9

(58) Field of Classification Search ..... 428/34.1, 428/34.2, 35.2, 35.7, 35.9, 36.9
See application file for complete search history.

(56) References Cited

U.S. PATENT DOCUMENTS

| | | | | |
|---|---|---|---|---|
| 3,021,990 | A * | 2/1962 | Duskey | 206/519 |
| 3,615,706 | A * | 10/1971 | Robinson | 426/107 |
| 5,098,793 | A * | 3/1992 | Rohrbach et al. | 428/532 |
| 6,196,960 | B1 * | 3/2001 | Owensby | 493/220 |
| 6,667,082 | B2 | 12/2003 | Bamore et al. | |
| 2003/0014947 | A1 * | 1/2003 | Deevi | 53/461 |
| 2005/0058827 | A1 * | 3/2005 | Arning et al. | 428/323 |

* cited by examiner

*Primary Examiner* — Marc Patterson

(57) ABSTRACT

A coated aromabag or aromafoil made of aluminum and methods of making it. The aromabag or aromafoil composition comprises an aluminum foil, a polymer or/and an aluminum oxide coated surface of at least one or more layers of flavor or aroma, an optional layer of a water-soluble thermoplastic polymer and an outer, especially a not black coating to increase the absorption of thermal radiation. The invention pertains to a process for preparing and packaging cooked or uncooked foodstuff with the aromabag or aromafoil made of aluminum at high temperatures in the range of 150° C. up to 600° C., especially 200° C. to 400° C.

1 Claim, No Drawings

AROMABAG AND AROMAFOIL MADE OF ALUMINUM

BACKGROUND OF THE INVENTION

1. Field of Invention

This invention relates to a black coated aromabag or aromafoil made of aluminum, especially for the usage for temperatures higher than 180° C. On its inside the bag is coated with water-soluble or heat-soluble polymer that includes the favoured flavors, spice or herbs. The aroma is distributed equally to the foodstuff during the grilling or preparation in the oven.

2. Description of the Prior Art

Packaging of foodstuff with inner layers of flavour already exist. They are made of plastic and applied to the cooking or heating of foodstuff in temperature ranges from 60° C. up to 90° C. They add their flavour to the foodstuff in this low temperature range while being heated.

The U.S. Pat. No. 6,667,082 or US2004048083 relates to a packaging that is coated with additive transfer film suitable for cook-in end use. It's a bag that owns a inner multilayer film which only can be used in temperatures under 100° C. and due to this is not useful for the roasting or grilling meat with temperatures from 180° C. up to 400° C.

The applications EP814023 and EP716031 relates to the same disadvantage for the application of high temperature ranges, because they all use thermoplastic foils as substrate. A second disadvantage is the supply of additives like for example flavor after or at the end of cooking. This is not useful for the equal distribution of the flavor during the whole cooking process. CA2049271 and EP473091 relate to an extruded thermoplastic foil, that contains some plastic bags filled with the desired additives. The fluid in the bags are added to the foodstuff when being cooked in hot water. These applications and the application U.S. Pat. No. 4,784,863 do not relate to any solution for high temperatures.

The company Sinituote Oy, Erkylän kartona 50,05820 Hyvinkää is the manufacturer of the aluminum SAVU Smoker bags, distributed in Europe and in the USA. Their bags contain natural wood chips, sugar and sirup but no chemicals to produce smoked meat in electric ovens or especially on the barbecue. The wood chips and sugar is added loose to the aluminum bag. The surface of the meat or foodstuff is not equally exposed to the flavor and even the wood chips can fall out of the bag, before the preparation of the food has started. The most important disadvantage of the SAVU smoker bag is its outside colour. The not black colored aluminum bag functions as a heating shield, which keeps the inside temperature of the bag on a low level. The reflection of thermal radiation on the outside and the loss of thermal energy, that is being transferred to the inside of the bag, increases cooking-time. It hinders or even prevents the non-enzymatic browning of the foodstuff in the bag.

SUMMARY OF THE INVENTION

The present invention solves the longstanding problem described above, by providing an aromabag or aromafoil that can be used in high temperature ranges from 180° C. up to 600° C., especially to 400° C. These temperatures occur during the breeding or grilling of meat in the oven or on the barbecue. The aromabags or aromafoil comprises to a uniformly coated inside of the bag to guarantee a equal exposition of the surface of foodstuff with the desired additives and flavor. The black colored outside of the bag comprises to the high absorption of thermal radiation and leads to an effective and quick browning of the foodstuff inside the bag.

DETAILED DESCRIPTION OF THE INVENTION

The problem of the invention is solved by the use of black or darkened aromabags or aromafoil made of aluminum.

A composition of the aromabag or -foil comprise:

I. An aluminum foil with a thickness from 5 mu m up to 300 mu meter.

II. An inner surface comprising, an additive transfer film including additives and flavor for the cooking of foodstuff III. An outer surface comprising, a surface coated with a pigment, that has an emissivity $\epsilon>0.56$. This can be a dark coloured pigment, especially a carbon black modification ($\epsilon>0.8$), like FW200, or inorganic iron(II,III) oxides ($\epsilon=0.56$) in order to increase the absorption of thermal radiation. But also white coloured pigments can be useful for some applications, especially Titanium oxide with Potassium Silicate ($\epsilon=0.92$) or Zinc Oxide with Sodium Silicate ($\epsilon=0.92$).

The inner surface of the aromafoil is the side, which is in contact with the meat or foodstuff being cooked. The outer surface of the foil is the side which is heated by the grill or oven. The emissivity $\epsilon$ is the ratio of the power W [Watt/m$^2$] or radiation a surface emits into a surrounding hemisphere and the total radiant power a perfect black body radiator emits, given by $W_B$ [Watt/m$^2$]$=\sigma T^4$ where $\sigma$=Stefan-Boltzmann constant. (see: Radiometric Properties of Isothermal Diffuse Wall Cavity Sources, Applied Optics, Vol. 13, page 2142, September 1974). The emissivity is also a good measure of the ability of a surface to absorb thermal radiation. A perfect black body radiator has the emissivity 1.

The given average emissivity values have been taken from the list published by Electro Optical Industries, Inc., 859 Ward Drive, Santa Barbara Calif. 93111, www.electro-optical.com.

The inner surface can be coated with a film consisting of Beta-Cyclodextrin inclusion compounds published 30 years ago in the application DD139 206. They release the included flavor or additives at the temperature of 200° C., which is preferably useful for temperature ranges of grilling meat or the cooking in electric ovens. In addition to this, all polymer binders used by foodstuff experts can be applied. For example Di- and Polysaccharides produced by the German company Südstärke GmbH, Königslachener Street 2A, in 86529 Schrobenhausen (Germany): Amylex, Dextrin, Cyclodextrin inclusion compounds, potato starch and Aero-Myl. Furthermore all modifications of food fat or oil or gelatine or animal or plant protein can be used.

In addition to flavor inclusions in the first layer of the inner surface antimicrobial or chelating agents can be added, according to the preferable application of the black aromabags. In some low cost applications, the desired film transfer might be reached by using just one layer on the inner surface. The heating of the aromabag liquefies the oil or gelatine binder and sets the flavor free. Even the starch is water-soluble and transfers the flavor, when getting in contact with the water vapour from the hot foodstuff inside the bag.

The first layer of the inner surface can be coated with a second layer to increase length of keeping time and storage. Also a higher hygienic standard can be reached by using a second layer of water-soluble, thermoplastic polymers like for example polyolefin or polyamides that are suggested in the applications U.S. Pat. No. 6,667,082 or US2004048083.

Another example of a composition of the aromabag or -foil comprises an inner surface with an electrolytic-anodic coating. The anodization produces a fine-pored layer of aluminum oxide on the inner surface. The pore size varies from 1 mu meter up to 60 mu meter and contains the flavor or additives in its volume of pore space. When the bag is being heated the flavor or perfume can be transferred. This example of coating aluminum foil has been suggested over 30 years ago in the application DE2404253. The binding of flavor to aluminum foil with layers of aluminum oxide is a non-toxic method of combine the additives with the aluminum foil in contradiction to coated plastic foil. A first layer of aluminum oxide on the inside of the bag can save the foodstuff from dissolved solid pollutants of toxic aluminum bonding. A non-stick coating on the inside of the bag can be in some applications useful but is in general not essential because of the food fat from the cooked foodstuff, that prevents the sticking on the surface of the foil.

The most important use of the outer surface consists of the high absorption of thermal radiation and the high thermal conductivity compared to any sort of plastic foil. The thermal absorption of untreated aluminum foil is very low and due to this the thermal receptivity is too low during the process of grilling (400° C.) and the cooking (200° C.). The thermal energy is being reflected by the untreated aluminium foil and the temperature on the inside of the bag is about 50° C. higher when using the black colored foil bag. This temperature shift inside the bag makes the results of cooking or grilling much better and uses the thermal energy in a better way. The outer dark, especially black surface is being coated with a pigment comprising a carbon modification, for example carbon black FW200 or a metal oxide, for example iron(II,III) oxide and a binder that is useful for the desired temperature range and application of the bag and foil.

Useful binders are stoving silicone lacquers or enamels, like for example Silikoftal non-stick, supplied by Tego-Chemie (Degussa), Goldschmidtstreet 100, 45127 Essen, Germany (www.tego.de) that are heated after the coating with temperatures higher than 250° C. to prepare a non-toxic coating. These polyester-modified methylphenyl polysiloxanes and hydroxyl functional silicone resins are also published in the US and German patents U.S. Pat. No. 6,696,511 (non-stick foil) and DE10035641. (dark metal foil). They are used and tested in foodstuff applications like non-stick grill-foil.

Another example of a useful binder for high temperature applications is the 20 year old application U.S. Pat. No. 4,439,239. The binder consists of mixture of hydrolyzable trialkoxysilane and a hydrolyzable dialkoxysilane, water, acidifying agent and an alcohol. The whole mixture becomes a polymeric binder in a sufficient acidifying agent from about 2.8 to 6.0. By using this binder the organic portion can be reduced to a percentage of 25 weight percent if desired and for the application useful.

Another example of a binder for high temperature usage is an organic-inorganic hybrid polymer published in the application EP1484372. The binder consists of organic-inorganic polymeric chains that are linked to Ormosil-monomers. For example Tetraethylorthosilicate that is linked to di-, tri- or tetrafunctional silicon alkoxides three-dimensional networks by a Sol-Gel transformation.

Another binder can be the Ormocer hybrid material published by the Fraunhofer Gesellschaft in Munich, Germany. Their hybrid material offers for a lot applications and the occurring temperature ranges binders to combine the carbon pigment with the aluminum surface.

Ormocer hybrid materials are mixtures of silicone and glass or ceramics that can be used as binders at the outer surface of the aromabag.

An example to blacken the outside of the bag without any binder and without any combustion gas is the reactive sputtering process published in EP 0231894 that produces a thin carbon film on the surface of the aluminum foil. In addition to this the outside coating to increase absorption of thermal radiation can also be a spectrally selective cathode sputtering film described in the application DE4433863 and EP0107412.

The application also includes the process of using an aromabag or aromafoil, described above, for the use of packaging any sort of foodstuff and to prepare it by positioning the aromabag or foil between the grill, oven or any heating source and the foodstuff.

The foregoing examples have been presented for the purpose of illustration and description only and are not to be construed as limiting the scope of the invention any way.

The scope of invention is to be determined from the claims appended thereto.

What is claimed is:

1. An aromabag or aromafoil multilayer composition comprising an aluminum foil with a thickness from 5 μm up to 300 μm as substrate, an inner surface comprising an additive transfer film including additives and flavor for the cooking of foodstuff and an outer not black surface comprising a surface coated with a not black pigment that has an emissivity ($\epsilon$>0.8), comprising titanium oxide with potassium silicate ($\epsilon$>0.92) or zinc oxide with sodium silicate ($\epsilon$>0.92) and a binder that is useful for the desired temperature range of 180 degrees Celsius to 600 degrees Celsius, wherein the inner surface of the aromafoil is the side which is in contact with the meat or foodstuff being cooked and wherein the outer surface of the foil is the side which is heated by the grill or oven.

* * * * *